US011377952B2

(12) United States Patent
Zhou et al.

(10) Patent No.: US 11,377,952 B2
(45) Date of Patent: Jul. 5, 2022

(54) METHOD FOR RADIALLY MINING OPEN-PIT END SLOPE PRESSED COAL

(71) Applicant: CHINA UNIVERSITY OF MINING AND TECHNOLOGY, Jiangsu (CN)

(72) Inventors: Nan Zhou, Jiangsu (CN); Jixiong Zhang, Jiangsu (CN); Hao Yan, Jiangsu (CN); Meng Li, Jiangsu (CN); Jiaqi Wang, Jiangsu (CN)

(73) Assignee: CHINA UNIVERSITY OF MINING AND TECHNOLOGY, Jiangsu (CN)

( * ) Notice: Subject to any disclaimer, the term of this patent is extended or adjusted under 35 U.S.C. 154(b) by 0 days.

(21) Appl. No.: 16/973,771

(22) PCT Filed: Oct. 8, 2019

(86) PCT No.: PCT/CN2019/109878
§ 371 (c)(1),
(2) Date: Dec. 10, 2020

(87) PCT Pub. No.: WO2020/192078
PCT Pub. Date: Oct. 1, 2020

(65) Prior Publication Data

US 2021/0254465 A1 Aug. 19, 2021

(30) Foreign Application Priority Data

Mar. 27, 2019 (CN) ..... 201910235248.9

(51) Int. Cl.
*E21C 47/02* (2006.01)
*E21F 1/04* (2006.01)
*E21C 41/28* (2006.01)

(52) U.S. Cl.
CPC ..... *E21C 47/02* (2013.01); *E21C 41/28* (2013.01); *E21F 1/04* (2013.01)

(58) Field of Classification Search
CPC ..... E21C 35/24; E21C 41/18; E21C 47/02; E21F 1/04; E21F 1/06; E21F 1/006
See application file for complete search history.

(56) References Cited

U.S. PATENT DOCUMENTS 2,651,513 A * 9/1953 Ramsay ..... E21C 41/18 299/11
3,225,678 A * 12/1965 Densmore ..... E21F 1/006 454/171

(Continued)

FOREIGN PATENT DOCUMENTS

CN 102003185 4/2011
CN 104074521 10/2014

(Continued)

OTHER PUBLICATIONS

"International Search Report (Form PCT/ISA/210)" of PCT/CN2019/109878, dated Dec. 30, 2019, with English translation thereof, pp. 1-6.

(Continued)

*Primary Examiner* — Janine M Kreck
(74) *Attorney, Agent, or Firm* — JCIP Global Inc.

(57) ABSTRACT

Provided is a method for radially mining open-pit end slope pressed coal, including: L-shaped or U-shaped main tunnel arrangements, and radially mining; branch tunnels are formed by excavating tunnels in directions perpendicular to or obliquely crossing the main tunnel from the L-shaped or U-shaped main tunnel; In the mining method, a coal mining system and a transportation system both adopt a remote control mode, a tunneling machine excavates a tunnel to product coal; a rubber belt conveyor conveys coal; the main tunnel adopts an exhaust ventilation mode, the branch tunnels adopt a blowing ventilation mode; the lengths of the branch tunnels do not exceed a farthest control distance of a remote control system; the length of each main tunnel (Continued)

needs to ensure that all the end slope pressed coal is mined under the premise that the branch tunnels do not exceed the farthest control distance of the remote control system.

8 Claims, 1 Drawing Sheet

(56) References Cited

U.S. PATENT DOCUMENTS

| | | | | |
|---|---|---|---|---|
| 4,195,886 | A * | 4/1980 | Roye | E21C 41/18 299/11 |
| 4,445,723 | A * | 5/1984 | McQuade | E21C 41/16 299/11 |
| 4,862,157 | A * | 8/1989 | Noel | H04B 3/542 340/3.9 |
| 5,782,539 | A * | 7/1998 | Peterson | E21C 41/18 299/11 |
| 6,554,368 | B2 * | 4/2003 | Drake | E21B 7/002 299/1.3 |
| 6,913,321 | B2 * | 7/2005 | Harman | E21C 41/16 299/18 |
| 10,113,425 | B2 * | 10/2018 | MacDonald | E21C 41/18 |
| 2007/0170771 | A1 * | 7/2007 | Cavinder | E21F 1/14 299/19 |

FOREIGN PATENT DOCUMENTS

| | | |
|---|---|---|
| CN | 104790956 | 7/2015 |
| CN | 105019904 | 11/2015 |
| CN | 106761755 | 5/2017 |
| CN | 107313804 | 11/2017 |
| CN | 109915148 | 6/2019 |

OTHER PUBLICATIONS

"Written Opinion of the International Searching Authority (Form PCT/ISA/237)" of PCT/CN2019/109878, dated Dec. 30, 2019, pp. 1-4.

* cited by examiner

METHOD FOR RADIALLY MINING OPEN-PIT END SLOPE PRESSED COAL

CROSS-REFERENCE TO RELATED APPLICATION

This application is a 371 of international application of PCT application serial no. PCT/CN2019/109878, filed on Oct. 8, 2019, which claims the priority benefit of China application no. 201910235248.9, filed on Mar. 27, 2019. The entirety of each of the above mentioned patent applications is hereby incorporated by reference herein and made a part of this specification.

TECHNICAL FIELD

The present invention relates to the technical field of coal mining, in particular to a method for radially mining open-pit end slope pressed coal, and more particularly to a method for mining open-pit end slope pressed coal to recover resources.

BACKGROUND

For an open-pit mine, the resource recovery rate in a boundary generally can reach about 95%. However, if the peripheral resources greater than an economic and reasonable stripping ratio and the resources pressed at a road side or a side slope are included, the resource recovery rate of an open-pit coal mine is only 75%. Especially, in northwest of China such as Ordos Inner Mongolia, Shenfu Shanbei and the like, an open-pit mine has a great deal of pressed coal at a side slope of a min pit; with the production of the open-pit mine and internal earth excavation, the side slope gradually becomes low until disappear, causing permanent loss to resources. In addition, end slope pressed coal would cause spontaneous coal seam combustion, which would pollute the air, damage surface vegetation, and is adverse to sustainable development of coal mines.

Therefore, for a series of problems that open-pit end slope pressed coal faces at present, under the background that China strongly advocates "save resource and protect environment", it has a very important significance and an application prospect to develop a method for safely and efficiently mining open-pit end slope pressed coal.

SUMMARY OF THE INVENTION

Object of the present invention: in order to overcome the defect in the prior art, the present invention provides a method for radially mining open-pit end slope pressed coal, so as to solve a series of problems that open-pit end slope pressed coal faces at present, and respond to the call of China "save resource and protect environment".

Technical solution: to achieve the above object, the technical solution adopted by the present invention is:

A method for radially mining open-pit end slope pressed coal, including the following steps:

a. using a tunneling machine to excavate an L-shaped or U-shaped main tunnel from an open-pit mine end slope, and supporting the excavated main tunnel with an anchor bar, an anchor cable, timber or other tools according to the situation of a top plate, wherein the main tunnel is used for coal transportation, material transportation, ventilation, people walking and the like; and b. excavating branch tunnels in various directions from the L-shaped or U-shaped main tunnel to perform radial coal mining, wherein the excavated branch tunnels are not supported.

Further, the L-shaped or U-shaped main tunnel is specifically: an L-shaped tunnel formed by remotely controlling the tunneling machine to inward excavate a tunnel from the open-pit mine end slope until a predetermined length, and then excavating another tunnel in a direction perpendicular to or obliquely crossing the tunnel; or a U-shaped tunnel formed by remotely controlling the tunneling machine to inward excavate two vertical or obliquely crossing tunnels from the open-pit mine end slope until a predetermined length, and then drilling the two tunnel through.

Further, in step b, the branch tunnels are excavated in directions perpendicular to or obliquely crossing the main tunnel from the L-shaped or U-shaped main tunnel to perform radial coal mining.

Further, the tunneling machine and a rubber belt conveyor are both remotely controlled by means of a remote control system in a remote control cabin.

Further, when the tunneling machine in each branch tunnel excavates the tunnel and produces coal, the coal is automatically shoveled to the rubber belt conveyor in the branch tunnel by the tunneling machine, and is then transported out by the rubber belt conveyor in the main tunnel.

Further, the rubber belt conveyor is driven by an electric roller; each section of rubber belt conveyor frame is 20 m long, and is mounted with two groups of travel wheels at the lower part; and every 20 m the rubber belt conveyor goes forward, a section of frame is connected at a tunnel opening.

Further, the main tunnel adopts an exhaust ventilation mode, and an exhaust ventilator is arranged at an opening of the L-shaped or U-shaped main tunnel; the branch tunnels adopt a blowing ventilation mode, and a local ventilator is respectively mounted on the rubber belt conveyor frame at the openings of the branch tunnels; a flame retardant air duct is used to provide air for a working face; every 10 m the rubber belt conveyor goes forward, the ventilator moves backward, and a 10 m air duct is connected.

Further, when the branch tunnels are excavated, a safety coal pillar with a certain width needs to be reserved therebetween.

Further, the excavating distances of the branch tunnels can be determined according to conditions on site, but the farthest excavating distance cannot exceed a farthest control distance of the remote control system; and the length of the main tunnel needs to ensure that all the end slope pressed coal is mined under the premise that the branch tunnels do not exceed the farthest control distance of the remote control system.

Beneficial effects: the method for radially mining open-pit end slope pressed coal disclosed by the present invention includes: L-shaped or U-shaped main tunnel arrangement, and radially mining; branch tunnels are formed by excavating tunnels in directions perpendicular to or obliquely crossing the main tunnel from the L-shaped or U-shaped main tunnel. In the mining method, a coal mining system and a transportation system both adopt a remote control mode; a tunneling machine excavates a tunnel to product coal; and a rubber belt conveyor conveys coal; the main tunnel adopts an exhaust ventilation mode, and the branch tunnels adopt a blowing ventilation mode; the lengths of the branch tunnels do not exceed a farthest control distance of a remote control system; and the length of the main tunnel needs to ensure that all the end slope pressed coal is mined under the premise that the branch tunnels do not exceed the farthest control distance of the remote control system. The end slope mining method has a flexible tunnel arrangement, a high mining efficiency, a simple production process, and low production cost, enables human and machine separated, requires less labor, and has certain economic benefit and social benefit. The present invention provides a novel technical method for the safe and efficient mining of open-pit end slope pressed coal in Northwest of China, and has a broad application prospect.

Figure 1:
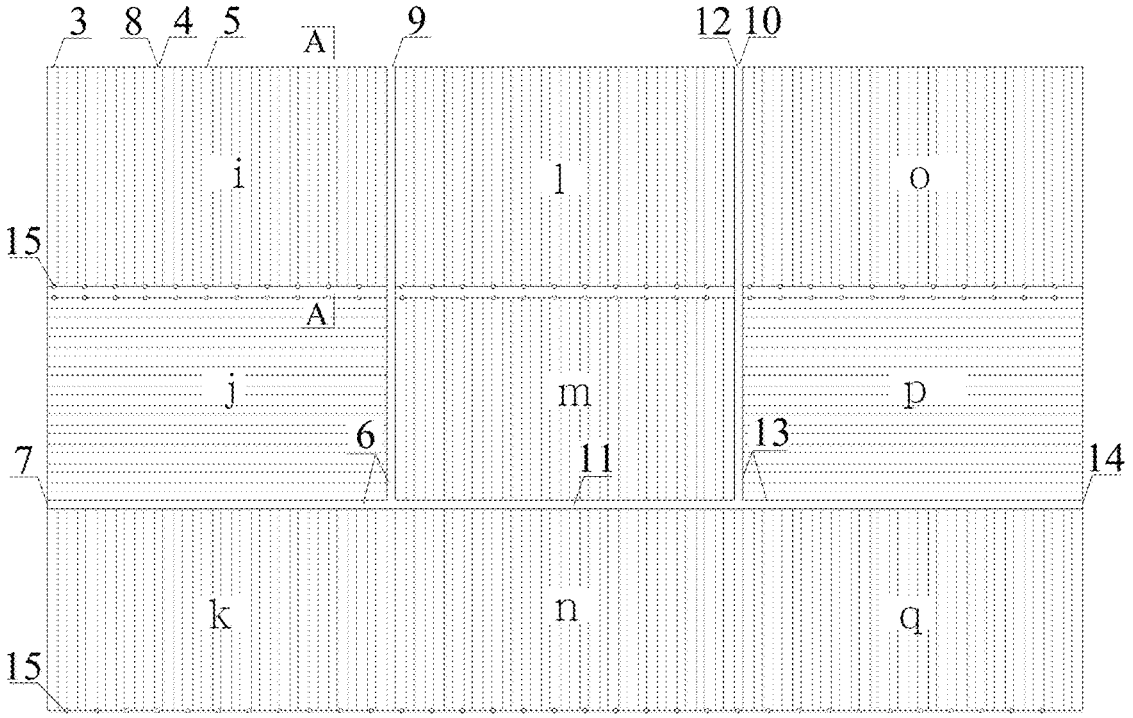
FIG. 1 is a schematic view of the method for radially mining open-pit end slope pressed coal.
Figure 2:
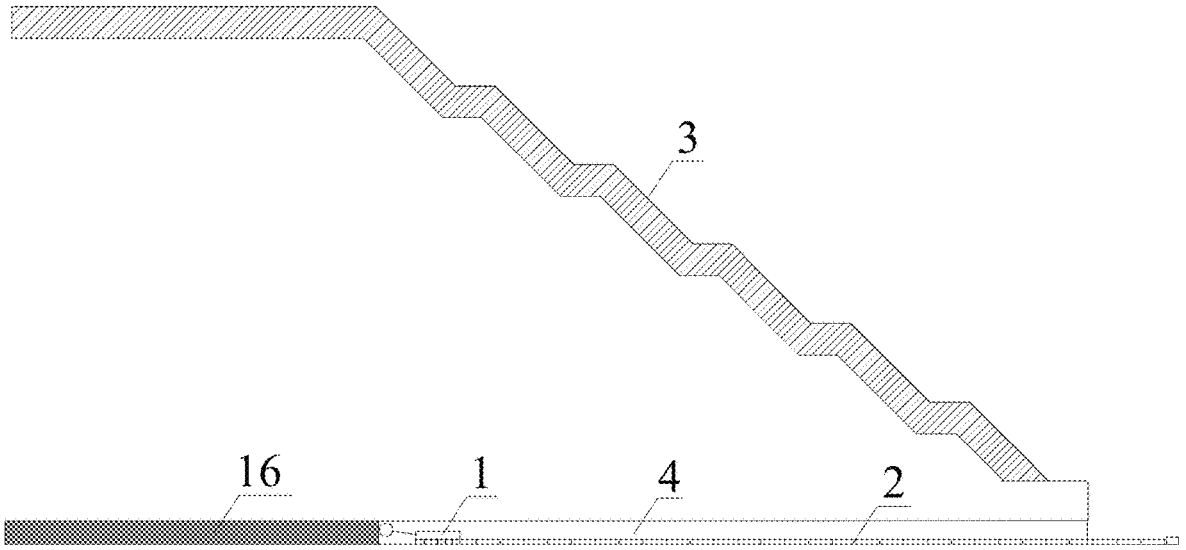
FIG. 2 is a sectional view of A-A of any one branch tunnel.

In the figures: 1, tunneling machine; 2, rubber belt conveyor; 3, open-pit mine end slope; 4, 9, 10, branch tunnels; 5, safety coal pillar; 6, 13, L-shaped main tunnel; 7, outlet of the L-shaped main tunnel 6; 8, opening of a branch tunnel; 11, U-shaped main tunnel; 12, outlet of the U-shaped main tunnel 11; 14, outlet of the L-shaped main tunnel 13; 15, stop mining line; 16, end slope pressed coal.

DETAILED DESCRIPTION OF THE EMBODIMENTS

An embodiment of the present invention will be further described hereafter in combination with the drawings. The following embodiment is only used to more clearly illustrate the technical solution of the present invention, but not intended to limit the protection scope of the present invention.

(1) A tunneling machine 1 and a rubber belt conveyor 2 are controlled by a remote control system in a remote control cabin; first, branch tunnels 4 in area i are excavated from an open-pit mine end slope 3 to produce coal; the lengths of the branch tunnels 4 can be determined according to conditions on site, but the farthest excavating distance cannot exceed a farthest control distance of the remote control system; and the excavated branch tunnels are not supported. A safety coal pillar 5 with a certain width needs to be reserved between two branch tunnels.

(2) After the area i is mined completely, an L-shaped main tunnel 6 is excavated; and the excavated main tunnel needs to be supported with an anchor bar, an anchor cable, timber or other tools according to the situation of a top plate, wherein the main tunnel is used for coal transportation, material transportation, ventilation, people walking and the like. In the same way, the branch tunnels in areas j and k of the L-shaped main tunnel 6 are continuously excavated to produce coal.

(3) When the tunneling machine in each branch tunnel excavates the tunnel and produces coal, the coal is automatically shoveled to the rubber belt conveyor 2 in the branch tunnel by the tunneling machine, and is then transported out by the rubber belt conveyor in the main tunnel. The rubber belt conveyor 2 in the branch tunnel is excavated by an electric roller; each section of rubber belt conveyor frame is 20 m long, and is mounted with two groups of travel wheels at the lower part; and every 20 m the rubber belt conveyor goes forward, a section of frame is connected at an opening of the branch tunnel.

(4) The L-shaped main tunnel 6 adopts an exhaust ventilation mode, and an exhaust ventilator is arranged at an opening 7 of the L-shaped main tunnel 6. The branch tunnels adopt a blowing ventilation mode, and a local ventilator is respectively mounted on the rubber belt conveyor frame at the openings 8 of the branch tunnels; a flame retardant air duct is used to provide air for a working face; every 10 m the rubber belt conveyor goes forward, the ventilator moves backward, and a 10 m air duct is connected.

(5) After the areas of the L-shaped main tunnel 6 are mined completely, an area l is mined in the same way, and the branch tunnels 9 and 10 are supported as a part of the U-shaped main tunnel 11; after the U-shaped main tunnel 11 is mined completely, areas m and n can be mined in the same way; and an exhaust ventilator is arranged at an opening 12 of the U-shaped main tunnel 11.

(6) Finally, areas o, p, and q of the L-shaped main tunnel 13 are mined, and an exhaust ventilator is arranged at an opening 14 of the L-shaped main tunnel 13.

The branch tunnels can be arranged transversely, vertically or obliquely. How the branch tunnels are arranged depends on the practical situation on site. The arrangement of the branch tunnels in FIG. 1 is only an example. The areas i, l, and o are arranged vertically because the tunnel can be directly excavated inward from the end slope, and the device is easier to arrange. The areas k, n, and q are arranged vertically because such arrangement does not need to excavate the main tunnel; and if the areas are arranged transversely, the main tunnel needs to be excavated. The areas j, m, and p can be arranged transversely or vertically, and the arrangement in the figure is only an example.

The descriptions above are only a preferred embodiment of the present invention. It should be noted that a person skilled in the art can make a plurality of improvements and modifications without departing from the principle of the present invention. These improvements and modifications should also be regarded as the protection scope of the present invention.

What is claimed is:

1. A method for radially mining open-pit end slope pressed coal, comprising the following steps:

a. using a tunneling machine to excavate an L-shaped or U-shaped main tunnel from an open-pit mine end slope, and supporting the excavated main tunnel; and b. excavating branch tunnels in various directions from the L-shaped or U-shaped main tunnel to perform radial coal mining, wherein the excavated branch tunnels are not supported, wherein the main tunnel adopts an exhaust ventilation mode, and an exhaust ventilator is arranged at an opening of the L-shaped or U-shaped main tunnel; the branch tunnels adopt a blowing ventilation mode, and a local ventilator is mounted on a rubber belt conveyor frame at the openings of the branch tunnels, a flame retardant air duct is used to provide air for a working face; every 10 m a rubber belt conveyor goes forward, the ventilator moves backward, and a 10 m air duct is connected.

2. The method for radially mining open-pit end slope pressed coal according to claim 1, wherein the L-shaped or U-shaped main tunnel is specifically:

an L-shaped tunnel formed by remotely controlling the tunneling machine to inwardly excavate a tunnel from the open-pit mine end slope until a predetermined length, and then excavating another tunnel a direction perpendicular to or obliquely crossing the tunnel; or a U-shaped tunnel formed by remotely controlling the tunneling machine to inwardly excavate two tunnels from the open-pit mine end slope until a predetermined length, and then connecting the two tunnels.

3. The method for radially mining open-pit end slope pressed coal according to claim 1, wherein in step b, the branch tunnels are excavated in directions perpendicular to or obliquely crossing a section of the L-shaped or U-shaped main tunnel from the L-shaped or U-shaped main tunnel.

4. The method for radially mining open-pit end slope pressed coal according to claim 1, wherein the tunneling machine and a rubber belt conveyor are both remotely controlled by means of a remote control system in a remote control cabin.

5. The method for radially mining open-pit end slope pressed coal according to claim 1, wherein when the tunneling machine in each branch tunnel excavates the branch tunnel and produces coal, the coal is automatically shoveled to a rubber belt conveyor in the branch tunnel by the tunneling machine, and is then transported out by a rubber belt conveyor in the L-shaped or U-shaped main tunnel.

6. The method for radially mining open-pit end slope pressed coal according to claim 5, wherein the rubber belt conveyor in the branch tunnel is driven by an electric roller; each section of the rubber belt conveyor frame is 20 m long, and is mounted with two groups of travel wheels at a lower part; and every 20 m the rubber belt conveyor goes forward, a section of the rubber belt conveyor frame is further connected at a tunnel opening of the branch tunnel.

7. The method for radially mining open-pit end slope pressed coal according to claim 1, wherein when the branch tunnels are excavated, a safety coal pillar is reserved therebetween.

8. The method for radially mining open-pit end slope pressed coal according to claim 1, wherein lengths of the branch tunnels do not exceed a farthest control distance of a remote control system; and a length of the L-shaped or U-shaped main tunnel needs to ensure that all the end slope pressed coal is mined while the branch tunnels do not exceed the farthest control distance of the remote control system.

* * * * *